United States Patent [19]

Piedmont

[11] Patent Number: 4,981,439

[45] Date of Patent: Jan. 1, 1991

[54] SAFETY COVER FOR AN ELECTRICAL WALL OUTLET

[76] Inventor: Gregory H. Piedmont, 13792 Old Hwy. 80, #44, El Cajon, Calif. 92021

[21] Appl. No.: 438,867

[22] Filed: Nov. 20, 1989

[51] Int. Cl.[5] ..... H01R 13/44

[52] U.S. Cl. ..... 439/135; 174/67; 439/374

[58] Field of Search ..... 439/135, 136, 142, 146, 439/147, 374; 174/67

[56] References Cited

U.S. PATENT DOCUMENTS

| | | | |
|---|---|---|---|
| 1,304,075 | 5/1919 | Lofgren | 439/319 |
| 2,878,456 | 3/1959 | Cormier | 439/142 |
| 3,054,080 | 9/1962 | Jepson | 439/374 |
| 3,317,881 | 5/1967 | Setecka | 439/140 |
| 3,631,320 | 12/1971 | Eckert | 439/135 |
| 3,930,704 | 6/1974 | Dekanic | 439/140 |
| 4,293,173 | 10/1981 | Tricca | 439/587 |
| 4,605,817 | 8/1986 | Lopez | 174/67 |
| 4,723,823 | 8/1986 | Pinkerton et al. | 439/136 |
| 4,902,238 | 2/1990 | Iacobucci | 439/135 |

*Primary Examiner*—Neil Abrams

*Attorney, Agent, or Firm*—Andsel Group, Inc.

[57] ABSTRACT

A safety cover for an electrical wall outlet is described that has a cover base plate and at least one cowl means attached to the base plate to enclose an electrical plug when the plug is in the electrical receptacle. The cover has a rail means in the inside circumferential surface of the cowl to guide the plug into the receptacle and to reduce the sagging of the plug while in the receptacle. This reduces possible accidental contact with the prongs of the plug when it is being inserted or extracted while the prongs of the plug are still in contact with the receptacle which reduces the chance of an electrical shock or a fire hazard. There is a protective cap means to place over the access port to the cowl to reduce the chance of undesired entry to the receptacle while the plug is not in place in the receptacle. There is a locking means on the cover comprising a locking pin on the outside surface of the cowl means and a J-shaped camming slot on the cap. There is a resilient means on the under surface of the top of the cap to encourage a firm locking engagement of the cap to the cowl when it is locked in place.

7 Claims, 1 Drawing Sheet

SAFETY COVER FOR AN ELECTRICAL WALL OUTLET

BACKGROUND OF THE INVENTION

1. Field of the Invention

This invention relates to a safety cover made of a nonconductive material for an electric wall outlet that reduces the potential for possible electrical shock when inserting or extracting a power appliance or tool.

2. Description of the Related Art

Each year people receive an electrical shock due to accidental contact with electrical plugs when plugging or unplugging the device to which the plug is connected. Also, many electrical outlets in older buildings become worn and allow the prongs of the plugs to be only loosely retained in the outlet or receptacles. This allows the plugs to sag and expose the electrically conductive prongs which are charged with electric current. This could result in accidental contact by a person unaware of this condition and its dangers or could result in a combustible material coming in contact with the exposed prongs and possibly causing a fire. Loose plugs also can lead to annoying loss of electrical power to an appliance or other device requiring electrical power. Most common outlets or receptacles rely on the ability of the outlet to provide the stability of the plug. The common plug does not guard against possible contact with the potentially harmful energy contained in the exposed prongs during extraction and insertion of the plug.

U.S. Pat. No. 3,317,881 to J. C. Setecka on May 2, 1966 shows a panel that receives a yieldible cushion that compresses when the plug is inserted into it until the prongs of the plug are resting in the outlet. The cushion then expands upon removal of the plug from the outlet.

U.S. Pat. No. 3,631,320 to William F. Eckert on Dec. 28, 1971 discloses a collapsible flexible sleeve that fits over the prongs of a plug. The sleeve collapses as the prongs of the plug are inserted into the outlet. There is provided in one embodiment a small tapered opening in the outlet plate which accepts the leading edge of the sleeve.

U.S. Pat. No. 3,930,704 to Dinko Dekanic on Jan. 6, 1976 shows spring loaded guiding devices that have to be moved into proper alignment before a plug can be inserted into an outlet.

U.S. Pat. No. 4,723,823 to Michael B. Pinkerton, et al. on Feb. 9, 1988 discloses a safety cap that screws onto a base plate with an external threaded boss. The cap can be used with a night light, as a cap to restrict access to an outlet or as a plug retainer.

SUMMARY OF THE INVENTION

The present invention is a nonconductive safety cover for an electrical wall outlet that is simple to install. Remove the fastening screw of the existing outlet. Save the screw and use the same screw to fasten the herein described safety cover. A cowl extends outwardly from the surface of the cover base plate in such a manner as to make it very difficult to allow the fingers to be in contact with the prongs of the plug when the prongs are in electrical contact with the outlet.

The invention provides a protective cap or cover which fits over the cowl when the outlet is not in use. The cowls are provided with a locking pin which extends outwardly from the outside circumferential surface of the cowl. The protective cap fits snugly over the top of the cowl sealing off access to the inside of the cowl. The cap has a J-shaped cam slot which intimately engages the locking pin.

Located on the inside circumferential surface of the cowl are at least two guide rails which engage the lower edge of the plug when the plug is inserted into the cowl of the safety cover. The rails guide the plug into the outlet and reduces sagging of the plug while in the outlet.

A safety cover for an electrical wall outlet is described that has a nonconductive cover base plate and at least one nonconductive cowl means attached to the cover base plate to enclose an electrical plug when the electrical plug is in electrical contact with an electrical receptacle. There is an outlet port in the cover base plate providing access to the electrical receptacle from the cowl means and a nonconductive guide rail means attached to an inside circumferential surface of the cowl means to guide the electrical plug into the electrical receptacle and to reduce sagging of the electrical plug while the electrical plug is inserted in the electrical receptacle. There is a nonconductive mounting screw chamber attached to the cover base plate to enclose a mounting screw and a mounting screw port means in the cover base plate to allow the mounting screw to pass from the mounting screw chamber and through the cover base plate to secure the cover base plate to the electrical receptacle.

There may be a nonconductive cap means to cover an access port in the cowl means and a nonconductive locking means to lock the cap means onto the cowl means and restrict access to the access port in the cowl means. There may be a nonconductive resilient means attached to an inside surface of a top portion of the cap means to encourage a firm locking engagement with the cowl means.

The locking means may have at least one nonconductive locking pin attached to the cowl means and a camming slot means in the cap means to receive and guide the locking pin. The camming slot means may be a J-shaped camming slot.

It is therefore one object of this invention to provide a safety cover that will reduce the chance of accidental contact with the prongs of an electrical plug while inserting and extracting the plug.

It is another object of this invention to provide a safety cover that will support the plug on guide rails that will assist the guiding of the plug into the outlet and reduce sagging of the plug while in contact with the outlet.

It is yet another object to provide a safety cover that is easy to place over the electrical wall outlet after removal of the other cover.

It is an object of the invention to provide a locking safety cover that allows the user to place a safety cap over the cowl to reduce accidental access to the outlet when there is no plug placed in the outlet.

DESCRIPTION OF THE PREFERRED EMBODIMENT

Figure 1:
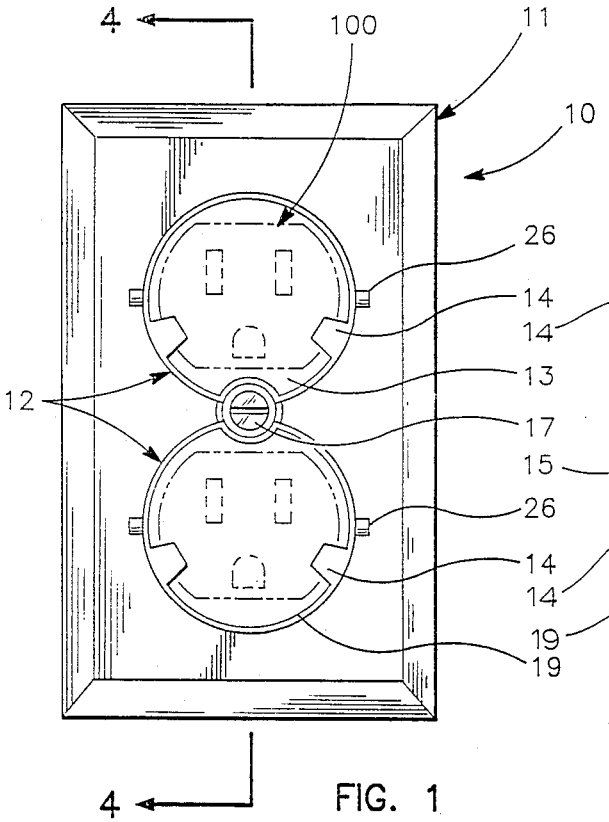
FIG. 1 is a front view of the safety cover placed over an electrical receptacle in phantom.
Figure 4:
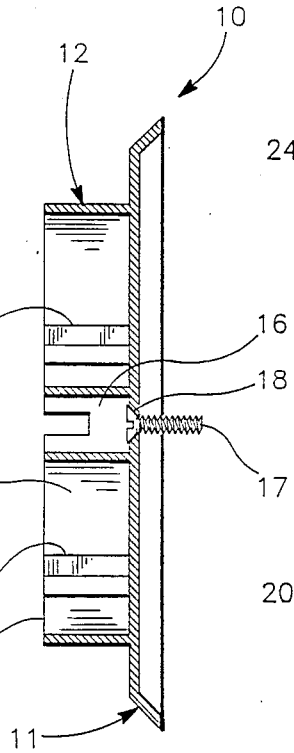
FIG. 4 is a cross-sectional view of the safety cover taken along line 4—4.
Figure 5:
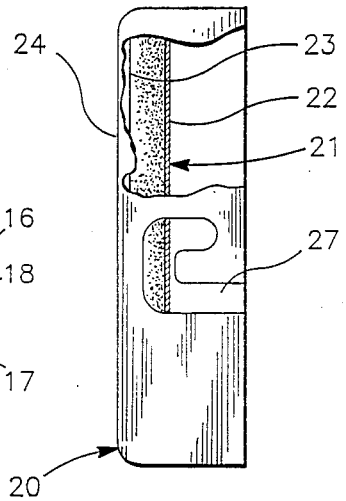
FIG. 5 is a fragmented side view of the cap means with a J-shaped camming means and also shows the resilient means.
Figure 3:
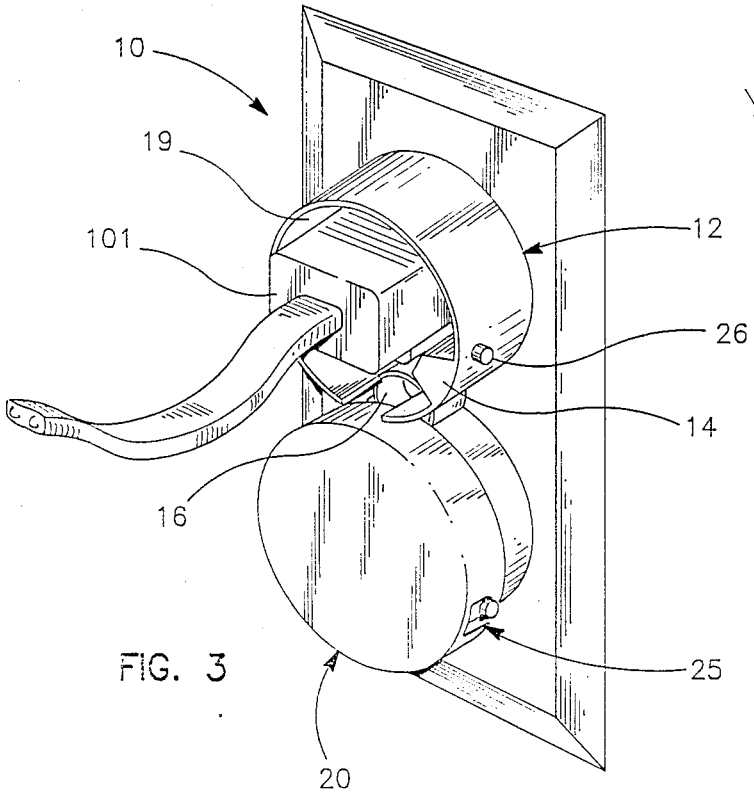
FIG. 3 is a perspective view of the safety cover shown in FIG. 2.
Figure 2:
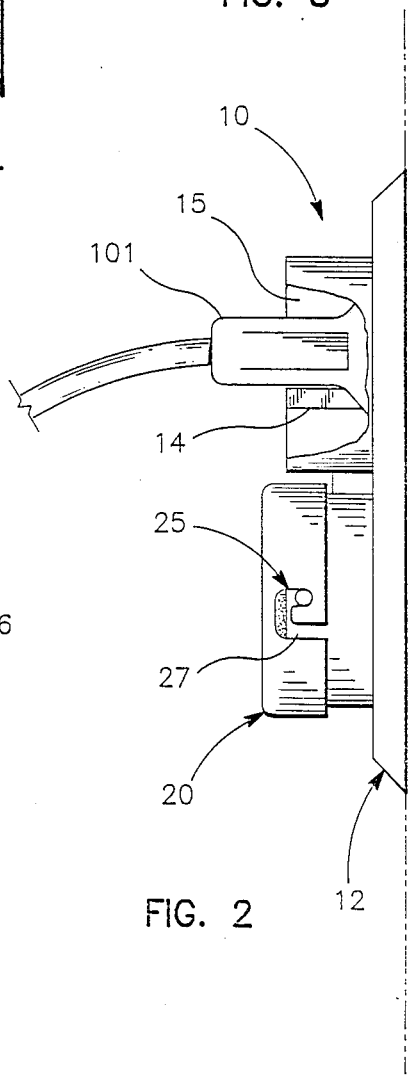
FIG. 2 is side view partly fragmented of the safety cover showing the cap means in place on a lower cowl means and a plug inserted in an upper cowl means and resting on the rail means.

Referring to FIGS. 1,2,3,4 and 5, a safety cover 10 for an electrical wall outlet 100 is shown. Electrical wall outlet 100 is shown in phantom in FIG. 1. The safety cover 10 is preferably made of a nonconductive material to reduce potential safety hazards. The safety cover 10 has a cover base plate 11 with at least one cowl means 12 attached to the cover base plate 11 to enclose an electrical plug 101 when the electrical plug 101 is in electrical contact with an electrical receptacle 100. The cowl means of the preferred embodiment is shown as basically cylindrical in shape and large enough to accept the plug 101 but small enough in its inner diameter to make it almost impossible to place a finger into the cowl when a standard size plug is being inserted, extracted or is resting therein. The cowl means could be any shape that would allow entry of the plug and yet reduce the chance of entry of the fingers when inserting or extracting the plug.

There is a outlet port means 13 in the cover base plate 11 providing access to the electrical receptacle 100 from the cowl means 12. There is a guide rail means 14 attached to an inside circumferential surface 15 of the cowl means 12 to guide the electrical plug 101 into the receptacle 100 and to reduce sagging of the plug 101 while the plug is inserted in the electrical receptacle 100.

There is a mounting screw chamber 16 attached to the cover base plate 11 to enclose a mounting screw 17 and a mounting screw port means 18 in the cover base plate 11 to allow the mounting screw 17 to pass from the mounting screw chamber 16 and through the cover base plate 11 to secure the cover base plate 11 to the electrical receptacle 100.

A cap means 20 is provided to cover an access port 19 in the cowl means 12. The cap 20 has a nonconductive resilient means 21 attached to an inside surface 23 of a top portion 24 of the cap means 20 to encourage a firm locking engagement with the cowl 12. The resilient material 21 may have a smooth cover liner 22 to protect the resilient means or material 21 if necessary due to the type of resilient material or means used.

There is a locking means 25 having at least one locking pin 26 attached to the cowl means 12 and a J-shaped camming slot means 27 in the cap 20 to receive and guide the locking pin 26 to lock the cap means 20 onto the cowl 12 and restrict access to the access port 19 in the cowl means.

The foregoing descriptions and drawings are explanatory and illustrative only, and various changes in shapes, sizes and arrangement of parts as well as certain details of the illustrated construction may be made within the scope of the appended claims without departing from the true spirit of the invention.

I claim:

1. A safety cover for an electrical wall outlet comprising:
   a. a nonconductive cover base plate;
   b. at least one nonconductive cowl means attached to the cover base plate to enclose an electrical plug when the electrical plug is in electrical contact with an electrical receptacle;
   c. an outlet port in the cover base plate providing access to the electrical receptacle from the cowl means;
   d. a nonconductive guide rail means attached to an inside circumferential surface of the cowl means to guide the electrical plug into the electrical receptacle and to reduce sagging of the electrical plug while the electrical plug is inserted in the electrical receptacle; and
   e. a nonconductive mounting screw chamber attached to the cover base plate to enclose a mounting screw and a mounting screw port means in the cover base plate to allow the mounting screw to pass from the mounting screw chamber and through the cover base plate to secure the cover base plate to the electrical receptacle.

2. A safety cover as defined in claim 1 further comprising:
   a. a nonconductive cap means to cover an access port in the cowl means; and
   b. a nonconductive locking means to lock the cap means onto the cowl means and restrict access to the access port in the cowl means.

3. A safety cover as defined in claim 2 wherein the cap means further comprises a nonconductive resilient means attached to an inside surface of a top portion of the cap means to encourage a firm locking engagement with the cowl means.

4. A safety cover as defined in claim 2 wherein the locking means further comprises:
   a. at least one nonconductive locking pin attached to the cowl means; and
   c. a camming slot means in the cap means to receive and guide the locking pin.

5. A safety cover as defined in claim 4 wherein the camming slot means is J-shaped.

6. A safety cover for an electrical wall outlet comprising:
   a. a nonconductive cover base plate;
   b. at least one nonconductive cowl means attached to the cover base plate to enclose an electrical plug when the electrical plug is in electrical contact with an electrical receptacle;
   c. an outlet port in the cover phase plate providing access to the electrical receptacle from the cowl means;
   d. a nonconductive guide rail means attached to an inside circumferential surface of the cowl means to guide the electrical plug into the electrical receptacle and to reduce sagging of the electrical plug while the electrical plug is inserted in the electrical receptacle;
   e. a nonconductive mounting screw chamber attached to the cover base plate to enclose a mounting screw and a mounting screw port means in the cover base plate to allow the mounting screw to pass from the mounting screw chamber and through the cover base plate to secure the cover base plate to the electrical receptacle;
   f. a nonconductive cap means to cover an access port in the cowl means;
   g. the cap means having a nonconductive resilient means attached to an inside surface of a top portion of the cap means to encourage a firm locking engagement with the cowl means; and h. a locking means having at least one nonconductive locking pin attached to the cowl means and a J-shaped camming slot means in the cap means to receive and guide the locking pin to lock the cap means onto the cowl means and restrict access to the access port in the cowl means.

7. A safety cover for an electrical wall outlet comprising:

a. a nonconductive cover base plate;

b. at least one nonconductive cowl attached to the cover base plate to enclose an electrical plug when the electrical plug is in electrical contact with an electrical receptacle;

c. an outlet port in the cover base plate providing access to the electrical receptacle from the cowl;

d. a nonconductive guide rail attached to an inside circumferential surface of the cowl to guide the electrical plug into the electrical receptacle and to reduce sagging of the electrical plug while the electrical plug is inserted in the electrical receptacle;

e. a nonconductive mounting screw chamber attached to the cover base plate to enclose a mounting screw and a mounting screw port in the cover base plate to allow the mounting screw to pass from the mounting screw chamber and through the cover base plate to secure the cover base plate to the electrical receptacle;

f. a nonconductive cap to cover an access port in the cowl;

g. the cap having a nonconductive resilient gasket attached to an inside surface of a top portion of the cap to encourage a firm locking engagement with the cowl; and h. a locking device having at least one nonconductive locking pin attached to the cowl and a J-shaped camming slot in the cap to receive and guide the locking pin to lock the cap onto the cowl and restrict access to the access port in the cowl.

* * * * *